US006070383A

United States Patent [19]

Jeanseau

[11] Patent Number: 6,070,383

[45] Date of Patent: Jun. 6, 2000

[54] CLEAN ROOM CEILING

[75] Inventor: Peter Jeanseau, San Ckemente, Calif.

[73] Assignee: HEPA Corporation, Anaheim, Calif.

[21] Appl. No.: 09/365,693

[22] Filed: Aug. 2, 1999

Related U.S. Application Data

[62] Division of application No. 08/925,762, Sep. 9, 1997, Pat. No. 5,946,875.

[51] Int. Cl.[7] ..... E04B 9/02; E04B 9/06

[52] U.S. Cl. ..... 52/506.05; 52/506.09; 52/511; 52/302.1; 454/187; 454/292; 55/508

[58] Field of Search ..... 52/506.05, 506.06, 52/506.08, 506.09, 511, 302.1; 454/187, 292, 296, 306; 55/508

[56] References Cited

U.S. PATENT DOCUMENTS 5,871,556 9/1999 Jeanseau et al. ..... 55/385.2
5,946,875 9/1999 Jeanseau ..... 52/506.08

*Primary Examiner*—Robert Canfield
*Attorney, Agent, or Firm*—Louis J. Bachand

[57] ABSTRACT

A clean room filter unit mounting system including a bracket, a bracket and fastener assembly, and individually mounted filter units. The bracket and fastener assembly includes a bracket having a relatively fixed member and a relatively movable member to allow misaligned mounting of parts such as the filter units in a clean room ceiling to fixed suspension rods without perfect registration of the bracket fixed member with the suspension rods, and a fastener able to pass through both bracket members in a first arrangement and to block such passage in a second disposition.

1 Claim, 5 Drawing Sheets

CLEAN ROOM CEILING

REFERENCE TO RELATED APPLICATIONS

This application is a division of my copending U.S. patent application Ser. No. 08/925,762, filed Sep. 9, 1997, now U.S. Pat. No. 5,946,875.

This invention has to do with a bracket and fastener assembly offering quick-connect fastening of parts or components whether or not the parts are perfectly aligned. More particularly, the invention relates to the ready installation and support of clean room ceilings, to filter units for clean room ceilings which are readily mounted with the bracket and fastener assembly, and to novel bracket and fastener assemblies. In this last aspect, the invention relates to brackets and assemblies of these brackets with fasteners for the installation of filter units in clean room ceilings, and in other mounting situations where misalignments of parts or components may be prevalent and interfittment of many units is required.

BACKGROUND OF THE INVENTION

Clean room ceilings, which term includes ceiling sections, and enclosed area walls and floors with a similar purpose, typically comprise a plurality of high efficiency filter units, e.g. HEPA and ULPA and similar filter units, arranged in rows and columns and supported by a suspension attached to an adjacent support surface, most commonly the true ceiling of room in which the clean room is located.

In an installation of a great number of filter units tolerances in the dimensions of the units may stack, resulting in misalignment of the filters with their suspension components, making completion of the installation difficult and problematical.

SUMMARY OF THE INVENTION

It is accordingly an object of the invention to provide an improved filter unit mounting system for clean room ceiling installations. It is another object to provide a variable, self-adjusting bracket and fastener assembly-based mounting system for these installations and for other purposes. A further object is to provide a clean room ceiling installation in which the individual filter units are supported by suspension rods which are fixed, the filter units having brackets according to the invention to allow for discrepancies in the registration or alignment of the mounting rods and brackets in effecting filter unit mounting. It is a further object to provide a bracket having a fixed opening and a movable opening for reception and retention of the suspension rod in mounting the filter unit in its place. A further object is the provision of a bracket and fastener assembly that enables the snap interfittment of two or more components by simply passing the fastener fixed to one component through an opening in the other component, the opening suitably being variable in location without change in interfittment capability for ready interfittment of the components in a variety of relative positions.

These and other objects of the invention to become apparent hereinafter are realized in a bracket for interconnecting a fixed unit, such as a suspension rod, and a movable unit subject to variable alignments, such as a filter unit, the bracket comprising a fixed bracket member defining a fixed opening connectable to the movable unit and a movable bracket member defining a movable opening variably registerable with the fixed opening by relative movement of the fixed and movable bracket members, the movable member opening being connectable with the fixed unit through the fixed member opening in different alignments of the fixed unit and the fixed opening to compensate for variations in the location of the fixed unit and the movable unit during their interconnection.

In this and like embodiments, typically: the movable bracket member is loosely captured on the fixed bracket member; the fixed bracket member and the movable bracket member define cooperating slots and ears for connection in loosely captured relation; or the movable member partially encloses and slides on the fixed member in loosely captured relation.

More particularly, in accordance with the invention, in a clean room ceiling embodiment, the movable unit typically comprises a filter unit comprising a filter pack in a frame having a wall, the fixed unit is a filter unit suspension rod fixed to a support surface, the filter unit wall defining the fixed bracket member and its the fixed opening opposite the suspension rod, the movable bracket member being loosely captured on the filter pack frame wall for movement to register with the suspension rod for engagement therewith when the fixed opening is out of registration with the suspension rod to suspend the filter unit from the suspension rod.

In this and like embodiments, typically, the filter unit wall defines a pair of transverse slots, the movable bracket member defines ears cooperating with the slots to loosely capture the movable bracket member; the movable unit comprises a filter unit comprising a filter pack in a frame having a wall, the fixed unit is a filter unit suspension rod fixed to a support surface, the bracket being mounted to the filter unit wall with its the fixed member fixed opening opposite the suspension rod in receiving relation, the bracket movable member lying parallel to and adjacent the fixed bracket member and loosely captured thereon by inturned flanges of the movable bracket member for movement to register with the suspension rod for engagement therewith when the fixed opening is out of registration with the suspension rod to suspend the filter unit from the suspension rod.

In a further embodiment, the invention provides a bracket for supporting a movable unit from a fixed unit, the bracket comprising a fixed bracket member having a fixed opening and a movable bracket member having a movable opening, the movable opening being variably registerable with the fixed opening in different alignments to compensate for variations in the location of the fixed opening.

In a further embodiment, the invention provides a bracket for suspending a clean room ceiling filter unit comprising a filter pack and a wall from a support surface with a support rod and fastener, the bracket comprising a fixed bracket member having a fixed opening and a movable bracket member having a movable opening, the movable opening being variably registerable with the fixed opening and adapted to retain the support rod and fastener in filter unit supporting relation, the fixed opening being adapted for receiving the movable opening retained support rod in different alignments to compensate for variations in the location of the fixed opening relative to the support rod and fastener.

The invention further includes in combination: the above bracket, and a fastener adapted to pass through the movable opening of the bracket in shaft supported relation in one direction only, such as a fastener comprising a lock body and a movable latch. In this and like embodiments, typically, the fastener comprises a lock body smaller than said movable opening, and at least one spring latch adapted to spring-project from the lock body against passage of the lock body through the movable opening.

There is further provided according to the invention an assembly of a bracket and fastener in which the bracket comprises a fixed bracket member having an fixed opening and a movable bracket member having a movable opening, the fastener comprising a lock body too large to pass through the movable bracket member opening but which will pass through the fixed member fixed opening, the bracket and fastener lock body being mounted on a common shaft.

In this and like embodiments, typically, the movable bracket member and the fixed bracket member define cooperating mounting structure for loosely capturing the movable bracket member on the fixed bracket member for relative movement to enable centering of the movable bracket member opening on the common shaft without the fixed bracket member opening being also centered on the shaft; the fastener lock body includes at least one spring latch within the lock body, the spring latch being adapted to fold into the body when the lock body passes through the movable bracket opening, and to project from the latch body once the lock body has passed through the movable bracket opening to block return passage of the lock body.

The invention further contemplates the combination of a filter unit and the invention bracket.

In yet another embodiment of the invention there is provided in combination: a clean room filter unit comprising a filter pack and a frame enclosing the filter pack; and a bracket for mounting the filter unit with a support rod and fastener to a support surface in varying alignments, the bracket comprising a fixed bracket member defining a fixed opening connectable to the movable unit and a movable bracket member defining a movable opening variably registerable with the fixed opening by relative movement of the fixed and movable bracket members, the movable member opening being connectable with the support rod and fastener through the fixed member opening in different alignments of the fixed unit and the fixed opening to compensate for variations in the location of the support rod and fastener and the filter unit during their interconnection.

In this and like embodiments, typically: the fixed bracket member is fixed to the filter unit frame, the movable bracket member being loosely captured on the fixed bracket member, and the filter unit frame has a wall portion defining the fixed bracket member, and the fixed and movable bracket members define cooperating slots and ears for their interconnection in loosely captured relation. Or, the filter unit frame has a wall portion, the bracket being fixed to the frame wall portion in spaced relation, and the bracket movable member partially encloses and slides on the bracket fixed member in loosely captured relation.

In a further embodiment there is provided a clean room ceiling comprising multiple filter units suspended from a support surface by a series of fixed suspension rods and fasteners, the filter units comprising a filter pack in a frame having a wall, each filter unit wall defining a fixed bracket member and a fixed opening therein opposite a suspension rod, a movable bracket member defining a movable opening, the movable bracket member being loosely captured on the fixed bracket member for movement to register its movable opening with the suspension rod for engagement therewith when the fixed opening is out of registration with the suspension rod to suspend the filter unit from the suspension rod in the clean room ceiling.

In this and like embodiments, typically: the fixed bracket member is an integral portion of the filter frame wall and defines a pair of transverse slots, the movable bracket member defining ears cooperating with the slots to loosely capture the movable bracket member on the frame wall portion, or the fixed bracket member is separately formed from the filter frame wall and mounted on the wall with a fixed opening opposite the suspension rod in receiving relation, the movable bracket member lying parallel to and adjacent the fixed bracket member and loosely captured thereon by inturned flanges of the movable bracket member for movement to register with the suspension rod for engagement therewith when the fixed opening is out of registration with the suspension rod to suspend the filter unit from the suspension rod.

Additionally, typically, the fastener comprises a lock body, and a movable latch finger mounted in the lock body under resilient force to be shiftable into and out from the lock body to pass through the fixed opening and the movable opening when shifted into the lock body and to block movement through the movable opening when shifted out from the lock body, the fastener may be threaded, or the fastener may be free of threaded attachment to the suspension rod, and there is also included a fastening nut threaded onto the suspension rod to support the fastener in place on the suspension rod.

In yet a further embodiment, the invention provides a clean room filter unit and mounting bracket for supporting the filter unit from a suspension rod attached to a support surface, the bracket comprising a fixed bracket member having a fixed opening and a movable bracket member having a movable opening, the movable opening being variably registerable with the fixed opening in different alignments to compensate for variations in the location of the fixed opening relative to the suspension rods.

In this and like embodiments, typically: the filter unit comprises a pair of filter packs, the filter unit frame has a perimetrical wall laterally enclosing the filter packs, the frame wall further comprises a divider separating the filter packs, the divider comprising a box-like member defining the fixed bracket member and its fixed opening opposite a suspension rod, the divider having an interior volume adapted to receive a suspension rod and a fastener; the movable bracket member lying generally within the divider interior volume, and the bracket structure flanges or ears lying outside the divider portion member volume, or the filter unit comprises a pair of filter packs, the filter unit frame has a perimetrical wall laterally enclosing the filter packs and a further wall portion for mounting the bracket, the bracket fixed member being generally U-shaped and having terminal flanges for attachment to the frame further wall portion, the movable bracket member being slidably secured to the bracket fixed member in spaced relation to the bracket fixed member flanges.

In another embodiment there is provided a clean room filter unit comprising a filter unit pack and a filter unit wall adjacent the filter pack, and a bracket for mounting the filter unit with a suspension rod and fastener to a support surface, the bracket comprising a filter a unit wall-supported bracket structure having a fixed member with a fixed opening and a relatively movable member with an opening variably registerable with the fixed opening, the fixed opening being adapted for receiving and retaining the suspension rod in different alignments to compensate for variations in the location of the fixed opening relative to the suspension rod.

In a still further embodiment, the invention provides a clean room filter ceiling comprising a plurality of individual filter units arranged for delivery of filtered air to a clean room, each of the filter units having a suspension assembly comprising a suspension rod extending from a support surface, a plate extending transversely of the suspension rod, a plurality of subsuspension rods extending from the plate to the filter units, the subsuspension rods being unshared with any other filter unit, whereby each filter unit is shiftable to and from the array independently of shifting the position or orientation of any other filter units or altering their respective suspension assemblies.

BRIEF DESCRIPTION OF THE DRAWINGS

The invention will be further described as to an illustrative embodiment in conjunction with the attached drawings, in which.

DETAILED DESCRIPTION OF THE INVENTION

As set forth above, the invention provides a bracket to accommodate misalignments of intended-to-be-interfitted components resulting from small discrepancies in dimensions or hardware mountings such as occurs in a series of filter units in a suspended clean room ceiling. These ceilings employ suspension rods as the suspending means, so as to maintain the separate mounting and demounting of the individual filter units. While built to specifications, filter units will vary in their dimensions and added hardware mounting points may not be always perfectly positioned. These construction errors, while minor, are cumulative, and in a ceiling which will embrace hundreds of filter units, mounting rods may not register with the filter units. Installation then becomes problematic. For example, with the filter units using fixed dividers as the mounting point, there is no opportunity to shift the mounting point to register with the suspension rods. In the invention, the mounting locus, defined by the divider mounting opening, or a fixed bracket member opening, is enlarged to accommodate a greater variation of relative placement of the filter unit and suspension rod. But the diametrical size of the fastener is limited and cannot be comparably enlarged and still fit within the divider, and be operative to anchor the filter unit in place. Accordingly, the invention provides a smaller and movable opening adapted to shift from concentricity with the fixed opening to register with the suspension rod, and engage the fastener, without having to adjust the intended position of the filter unit. The invention assembly of the bracket and fastener is used particularly for filter unit mounting in a clean room situation as an illustrative embodiment.

Figure 7:
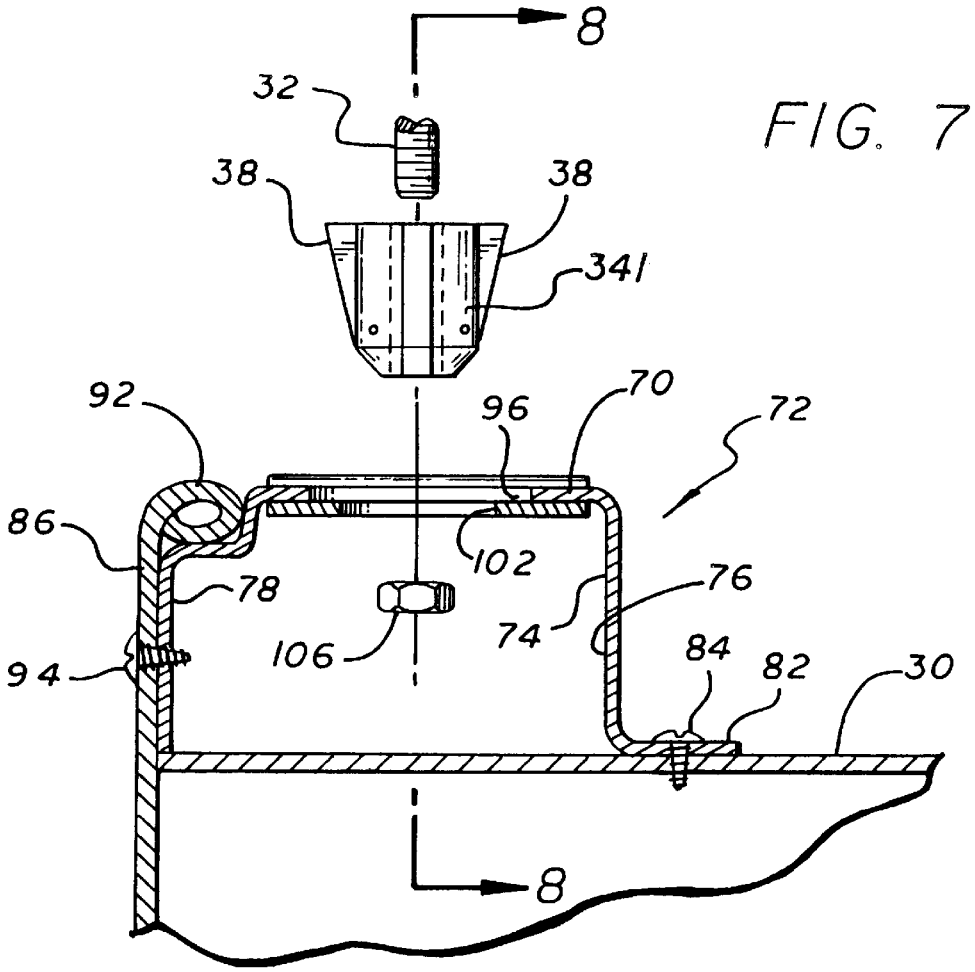
FIG. 7 is a view taken on line 7—7 in FIG. 6.
Figure 8:
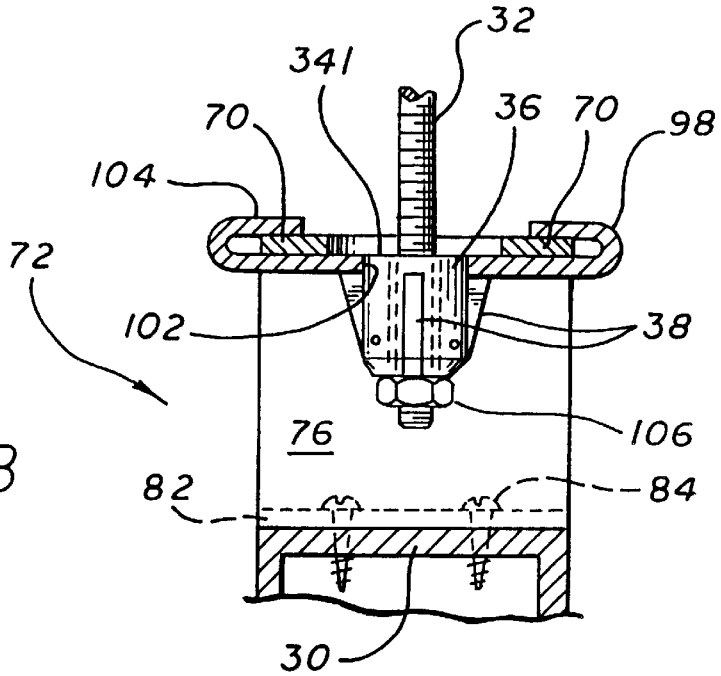
FIG. 8 is a view taken on line 8—8 in FIG. 7.

With reference now to the drawings in detail, FIGS. 1–4 show a first embodiment in which a clean room ceiling 10 is suspended above a clean room space 12 and below a support surface 14 which is typically the true ceiling in the room. The clean room ceiling 10 comprise multiple rows and columns of filter units 16. Each filter unit 16 comprises a pair of filter packs 18, comprising HEPA or ULPA filters, typically, a surrounding frame 20 having a sealing rib 21 running perimetrically about the frame and aiding sealing together of adjacent filter units. The filter unit frame 20 includes a perimetrical wall 22 which laterally encloses the filter packs 18, and a divider 24 which separates the filter packs and extends transversely of the filter unit 16. First and second openings 26, 28 are formed in the divider 24 at its upper wall 30 for the purpose of receiving in registered relation support rods 32 depending from support surface 14 and their associated fasteners 34. Fasteners 34 are internally threaded to thread-connect to rods 32, or may be smooth bored to slide upon rods 32, and be held in place by a fastening nut 106. See FIGS. 7 and 8.

The openings 26, 28 are oversized relative to fastener 34 and will not retain the fastener in place. See FIG. 3. The openings 26, 28 further are sized to receive rods 32 in various alignments of the rod axis to the axis of the opening 26 or 28. See FIGS. 3 and 4. In a perfect alignment of the axes of the rods 32 and the openings 26, 28 are coaxial. In many, if not most, installation situations the alignments of the openings 26, 28 and the rods 32 will not be perfect. Typically, the rods 32 will register imperfectly with the openings 26, 28, either to one side or the other, so that they are paraxial, not coaxial. In this event, the greater diameter of the openings 26, 28, a diameter large enough that the fasteners 34 will pass through in either direction, and typically more than twice or more the diameter of the rods 32 passing therethrough, will allow the rods to be left in their place as installed and the filter units 16 to be installed where they fall in the assembly of the clean room ceiling rows and columns of filter units.

As noted, the fasteners 34 will not be retained in the openings 26, 28. The fasteners 34 comprise a lock body 36 having a plurality of latch fingers 38, which are pivotally mounted within slots 42 of the lock body and outwardly biased by compression springs 48. In assembly of the clean room ceiling, the fasteners 34 are threaded or otherwise connected to the rods 32. The filter units 16 are urged upward toward the rods 32 with their divider openings 26, 28 aligned with the fasteners 34 on the rods. The fasteners 34 pass through the openings 26, 28 and if the openings are small enough or the fastener 34 large enough, the fasteners will latch to the wall edge margin 44 surrounding the openings 26, 28 by virtue of the latch fingers 38 springing out after being compressed inward by passage through the opening. The latch fingers 38 thus support the filter unit 16 where those latch fingers extend far enough to engage the wall edge margin 44.

In the embodiment shown in FIGS. 1–4, the openings 26, 28 are too large for even the latch fingers 38 to engage the wall edge margin 44. The invention provides for supporting engagement of the latch fingers 38 and a further element, a generally shallow U-shaped member 52 having ears 54 and a central opening 56. Member 52 and the upper divider wall 30 form a bracket according to the invention. The upper wall 30 is a fixed bracket member; the member 52 is a movable bracket member. Opening 56 is movable since the member 52 is movable. The member 52 lies generally parallel to and adjacent the divider upper wall 30. Member ears 54 are inserted in slots 58, 60 formed in the divider upper wall 30 on either side of the openings 26, 28, respectively. Slots 58, 60 are larger than the ears 54 so that the member 52 will shift parallel to the long axis of the divider upper wall 30 or transversely thereto. The slots 58, 60 are not so large that the ears 54 will separate from the slots in the installed condition of member 52. The member 52 is loosely captured by being able to shift in position relative to its mounting slots 58, 60, but not escape from that mounting locus. The central opening 56 is thus registered with the opening 26 or 28 but not precisely except when the two openings are concentric. Any other form of mounting the movable bracket member 52 to the fixed bracket member, divider upper wall 30, can be used in place of the ears 54 and slots 58, 60 arrangement shown, provided a degree of movability is retained sufficient to accommodate the expected variations in perfection of registration, and the structure is strong enough to support the filter units 16.

In practice, the member 52 will shift approximately ⅛–¼ inch or more or less, longitudinally or transversely, depending on the design, moving its central opening 56 accordingly. The central opening 56 is sized to just receive the fastener 34 with the latch fingers 38 closed into the lock body 36. Upon full passage of the fastener 34 through the central opening 56 (it has already passed the opening 26 or 28), the latch fingers 38 open, engaging the edge margin 62 surrounding the opening 56. The filter unit 16 is thus supported.

Figure 1:
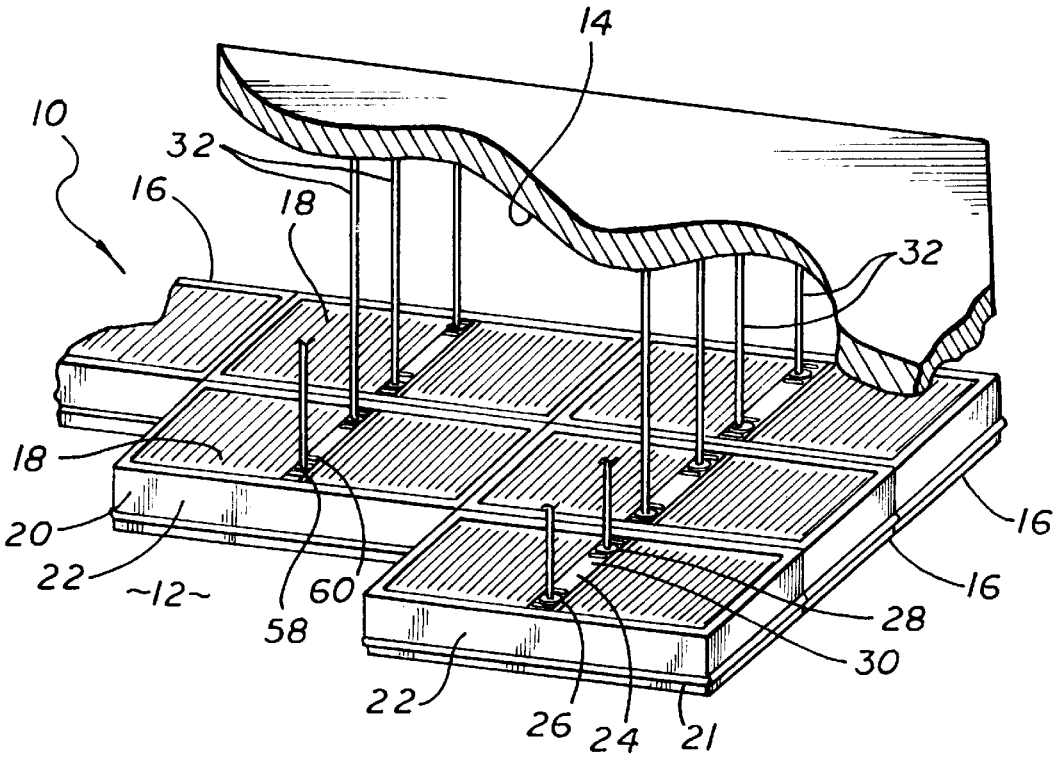
FIG. 1 is a perspective view of a clean room ceiling according to the invention.
Figure 2:
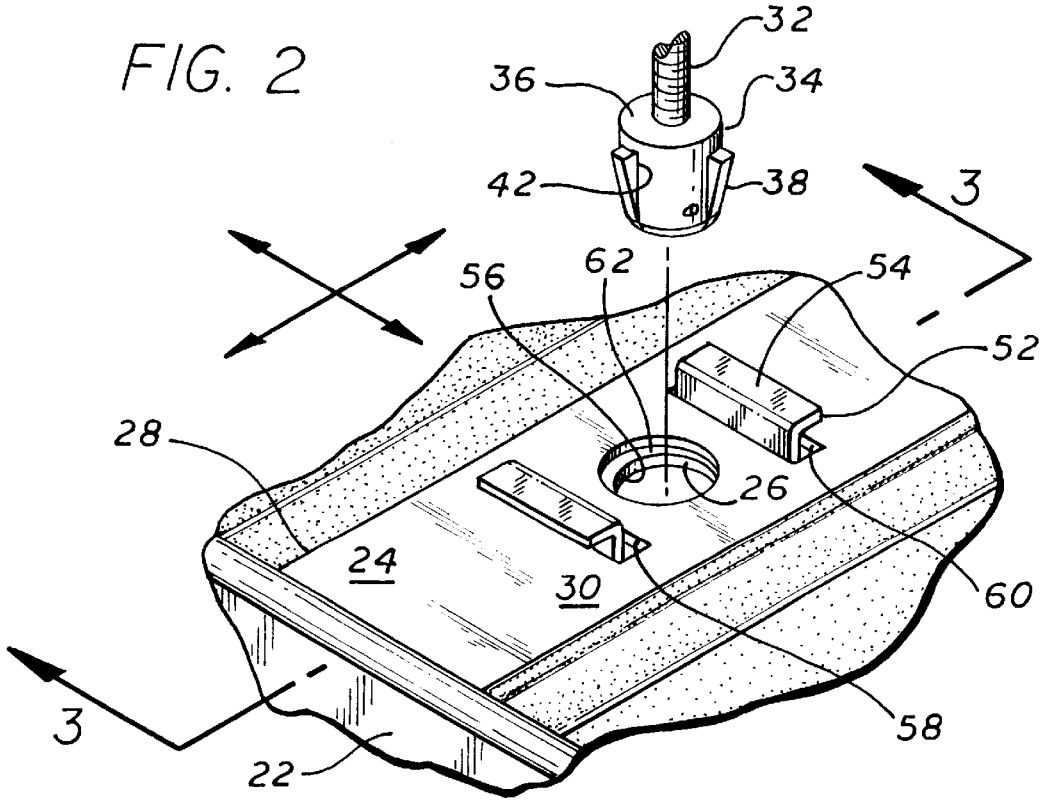
FIG. 2 is a fragmentary detail view of the invention bracket and filter unit assembly.
Figure 3:
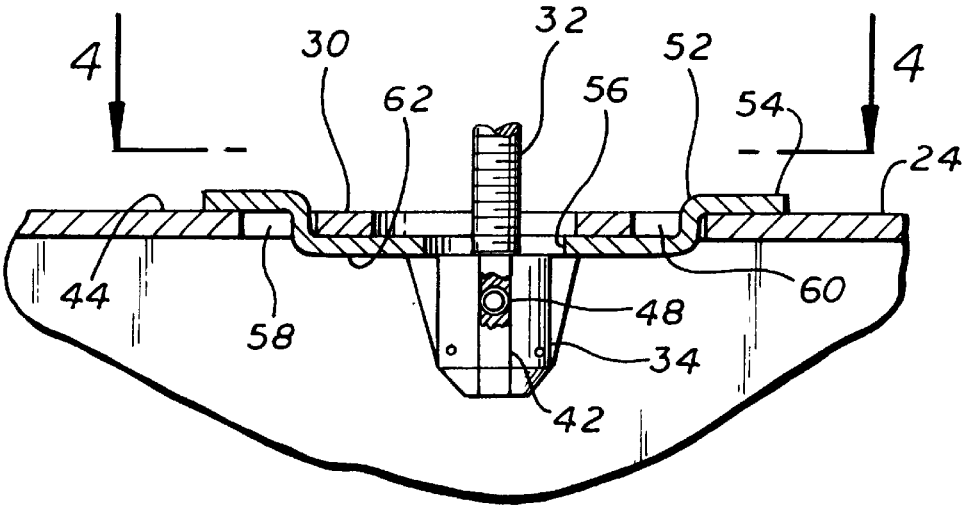
FIG. 3 a view taken on line 3—3 in FIG. 2.
Figure 4:
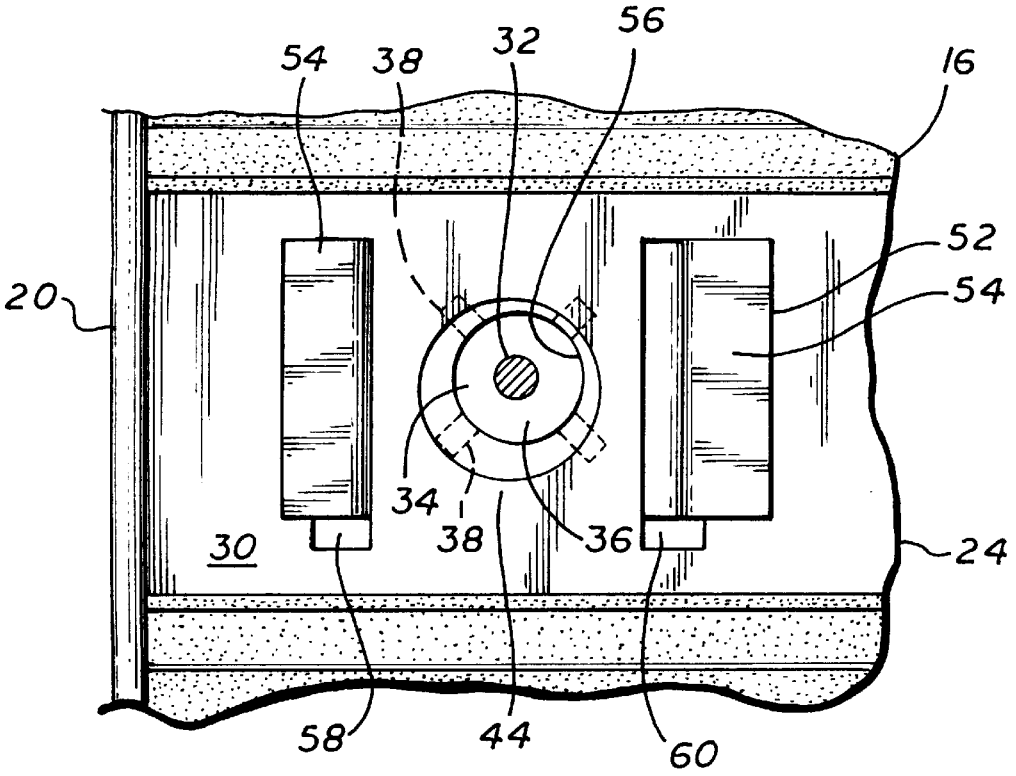
FIG. 4 is a view taken on line 4—4 in FIG. 3.
Figure 5:
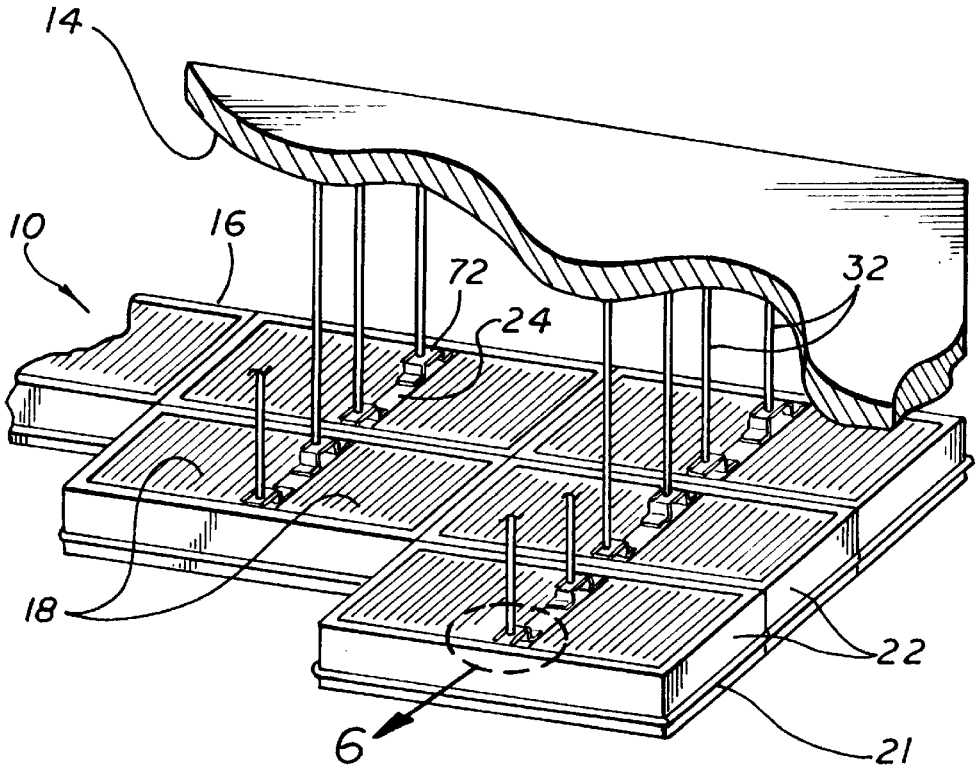
FIG. 5 is a view like FIG. 1 showing an alternate bracket and filter unit arrangement.
Figure 6:
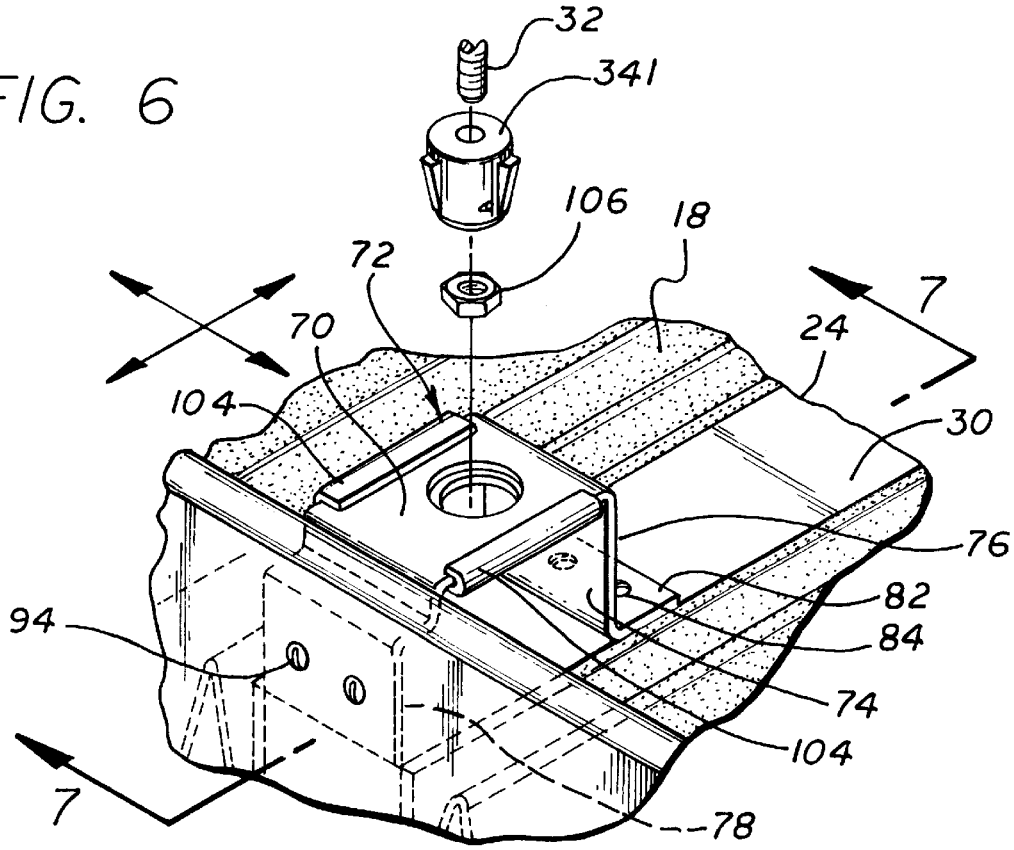
FIG. 6 is a view like FIG. 2 but of the alternate form of the invention, and including the invention bracket and fastener subassembly.

In FIGS. 5–8 a second embodiment of the invention is shown. The general assembly, shown in FIG. 5 is similar to the embodiment of FIG. 1 with the filter units 16 being supported from a support surface 14 by a series of support rods 32. In this embodiment, the filter divider upper wall 30 is not apertured with openings such as openings 26, 28 in the earlier embodiment. Instead, a separate bracket 72 is provided, attached to the divider upper wall 30 by screws, rivets or other common fastener, or glued in place. The bracket 72 has a fixed member 74, generally U-shaped, having a first leg 76, a second leg 78 and a flange 82 on the first leg flat to the divider upper wall 30 and secured there by screws 84 or the like. The member 74 second leg 78 butts against the flange 86 defined by the freeboard of the filter unit perimetrical wall 22 above the tops of the filter packs 18, contoured as necessary to fit wall lip 92 and fastened by screws 94. Bracket wall 70 defines a too large opening 96 (like divider openings 26, 28) in the sense that the fastener 34 will pass through and not securely engage this opening even with the latch fingers 38 deployed.

Bracket 72 has a movable member in the form of clip 98, a typically metal member defining a movable opening 102 variously registerable with bracket opening 96 in the manner of previously discussed opening 56. The clip 98 is loosely captured on the bracket fixed wall member 70 so as to slide back and forth and in and out all while engaged in sliding relation with the wall. The clip 98 has inturned flanges 104 which are crimped to enclose the fixed member wall 70 parallel to and adjacent to the wall and with its movable opening 102 in various registrations with opening 96. In practice, the fastener 341, alike to fastener 34 except in having a smooth interior bore rather than a threaded bore, is mounted on the rod 32 and secured there with a fastener nut 106. Pushing the filter unit 16 to the rod 32 aligned with the openings 96 and 102, depresses the latch fingers 38, and allows the filter unit to be mounted to the rod by the bracket 72. The movable opening 102 is centered on the fastener by the latch finger 38 action, the necessary movement of the movable opening relative to the bracket fixed opening 96 being accommodated by the sliding of the clip 98 on the bracket wall 70. The use of brackets 70 with openings 96, 102, rather than a series of divider wall openings 26, 28, increases manufacturing flexibility and enables the use of the individually supported filter units 16 in situations where access to the divider wall is limited, as in filters having associated housings, or hooks where it is desired to support the filter unit from its edges rather than from a center divider.

Figure 9:
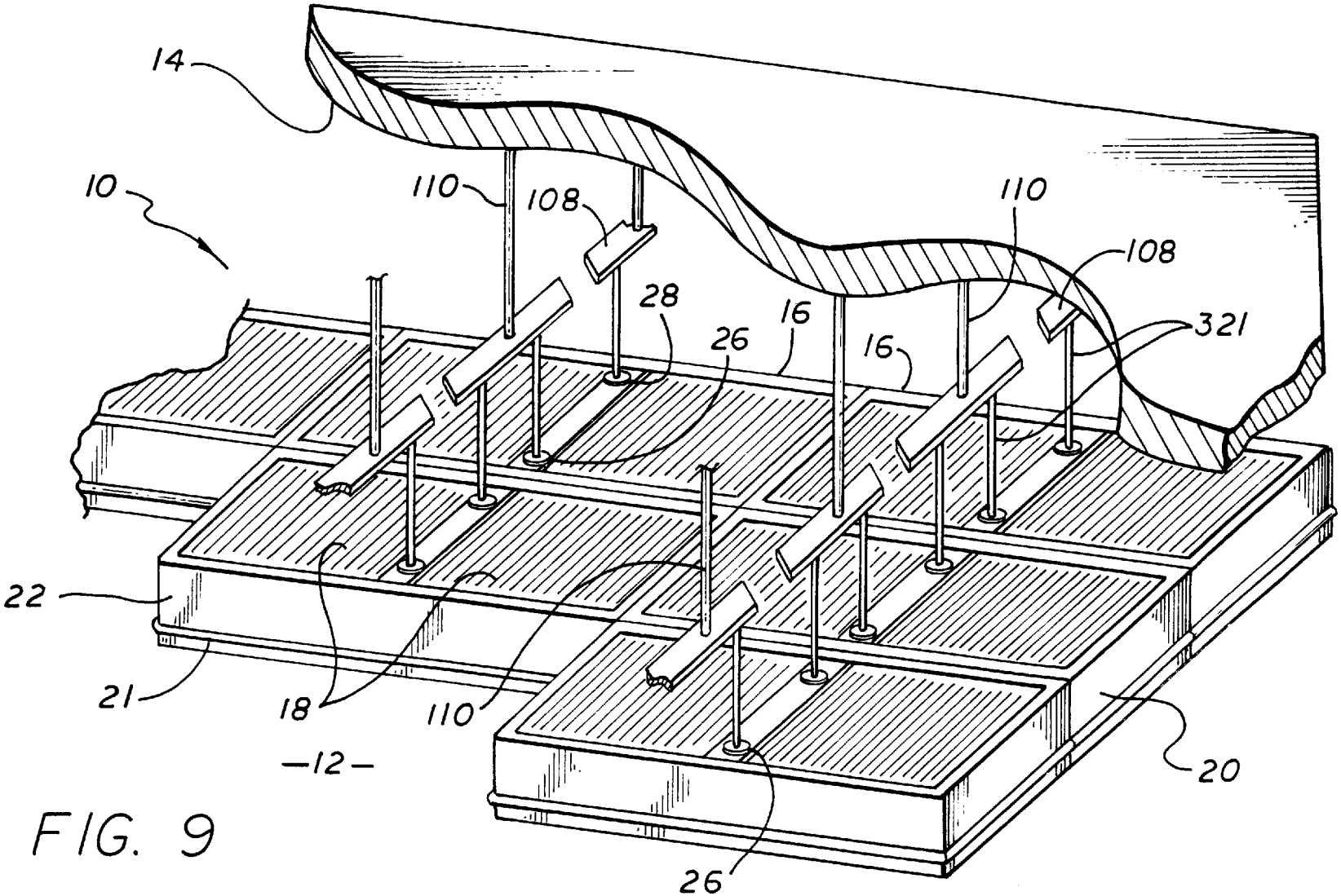
FIG. 9 is a view like FIG. 1, showing an alternate form of suspension rod mounting of clean room ceiling filter units.

In FIG. 9, the rods 321 are subsuspension rods and are shown to depend from plates 108 which are in turn supported by a lesser number of supports 110 anchored to the ceiling/support surface 14. This manner of support/rod deployment requires fewer attachments to the ceiling and is less costly than the deployment in manner shown in FIGS. 1 and 5.

The invention thus provides an improved filter unit mounting system for clean room ceiling installations, using a variable bracket mounting system to allow for discrepancies in the registration or alignment of the mounting rods and brackets in effecting filter unit mounting, the bracket having a fixed opening and a movable opening for reception and retention of the suspension rod in mounting the filter unit in its place.

I claim:

1. A clean room filter ceiling comprising a plurality of individual filter units arrange for delivery of filtered air to a clean room, each of the filter units having a suspension assembly comprising a suspension rod extending from a support surface, a plate extending transversely of said suspension rod, a plurality of subsuspension rods extending from said plate to said filter unit, each said subsuspension rod being unshared with any other filter unit, whereby each filter unit is shiftable to and from the array independently of shifting the position or orientation of any other filter units or altering their respective suspension assemblies.

* * * * *